US011003112B2

(12) United States Patent
Saeki

(10) Patent No.: US 11,003,112 B2
(45) Date of Patent: May 11, 2021

(54) IMAGE FORMING APPARATUS

(71) Applicant: TOSHIBA TEC KABUSHIKI KAISHA, Tokyo (JP)

(72) Inventor: Ryota Saeki, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/683,028

(22) Filed: Nov. 13, 2019

(65) Prior Publication Data

US 2020/0233342 A1 Jul. 23, 2020

(30) Foreign Application Priority Data

Jan. 23, 2019 (JP) ..... JP2019-009431
Sep. 11, 2019 (JP) ..... JP2019-165654

(51) Int. Cl.
*G03G 15/20* (2006.01)

(52) U.S. Cl.
CPC ..... *G03G 15/2025* (2013.01); *G03G 15/2035* (2013.01)

(58) Field of Classification Search
CPC ..... G03G 15/2025; G03G 15/2032; G03G 15/2035
See application file for complete search history.

(56) References Cited

U.S. PATENT DOCUMENTS

2008/0298824 A1* 12/2008 Kanno ..... G03G 15/2039 399/33
2011/0097093 A1* 4/2011 Birumachi ..... G03G 15/2032 399/21
2011/0222875 A1* 9/2011 Imada ..... G03G 15/2025 399/33
2018/0329342 A1* 11/2018 Seshita ..... G03G 15/2025
2020/0073301 A1* 3/2020 Sakai ..... G03G 15/1615

FOREIGN PATENT DOCUMENTS

JP 2011-033654 A 2/2011
JP 2011-253000 A 12/2011
JP 2015166793 A 9/2015
JP 2019007989 A 1/2019

OTHER PUBLICATIONS

Extended European Search Report dated Jun. 9, 2020 in related European Patent Application 19218209.5, 8 pages.
English Machine Translation of JP 2019-253000, 20 pages.

* cited by examiner

*Primary Examiner* — Carla J Therrien
(74) *Attorney, Agent, or Firm* — Kim & Stewart LLP

(57) ABSTRACT

An image forming apparatus includes a fixing device and a processor. The fixing device has a heat generating element, a fixing belt which moves along a surface of the heat generating element while an inner peripheral surface of the fixing belt makes contact with the heat generating element, a rotatable body configured to be pressed against an outer peripheral surface of the fixing belt, and a lubricant which is applied to and in contact with the inner peripheral surface of the fixing belt. The processor is configured to acquire a physical quantity which changes in accordance with a magnitude of a torque that is applied to rotate the rotatable body, and cause the rotatable body to execute a predetermined operation to adjust a gap between the heat generating element and the fixing belt, based on the physical quantity acquired while the fixing device is carrying out image formation.

16 Claims, 9 Drawing Sheets

IMAGE FORMING APPARATUS

CROSS-REFERENCE TO RELATED APPLICATIONS

This application is based upon and claims the benefit of priority from Japanese Patent Application No. P2019-009431, filed on Jan. 23, 2019, and Japanese Patent Application No. P2019-165654, filed on Sep. 11, 2019; the entire contents of both applications are incorporated herein by reference.

FIELD

An embodiment relates to an image forming apparatus.

BACKGROUND

An image forming apparatus forms an image on a sheet using a developer such as toner or the like. The image forming apparatus fixes an image formed on a sheet by heating the sheet. There is a fixing device using a planar heater and an endless belt (e.g., fixing belt). In such a fixing device, since a lubricant is disposed between the heater and the fixing belt, the driving torque of the fixing device is reduced. However, when the lubricant between the heater and the fixing belt deteriorates, the driving torque of the fixing device may increase.

DETAILED DESCRIPTION

The image forming apparatus of the embodiment includes a fixing device and a processor. The fixing device has a heat generating element, a fixing belt which moves along a surface of the heat generating element while an inner peripheral surface of the fixing belt makes contact with the heat generating element, a rotatable body configured to be pressed against an outer peripheral surface of the fixing belt, and a lubricant which is applied to and in contact with the inner peripheral surface of the fixing belt. The processor is configured to acquire a physical quantity which changes in accordance with a magnitude of a torque that is applied to rotate the rotatable body, and cause the rotatable body to execute a predetermined operation to adjust a gap between the heat generating element and the fixing belt, based on the physical quantity acquired while the fixing device is carrying out image formation.

Hereinafter, an image forming apparatus according to an embodiment will be described with reference to the drawings.

First Embodiment

Figure 1:
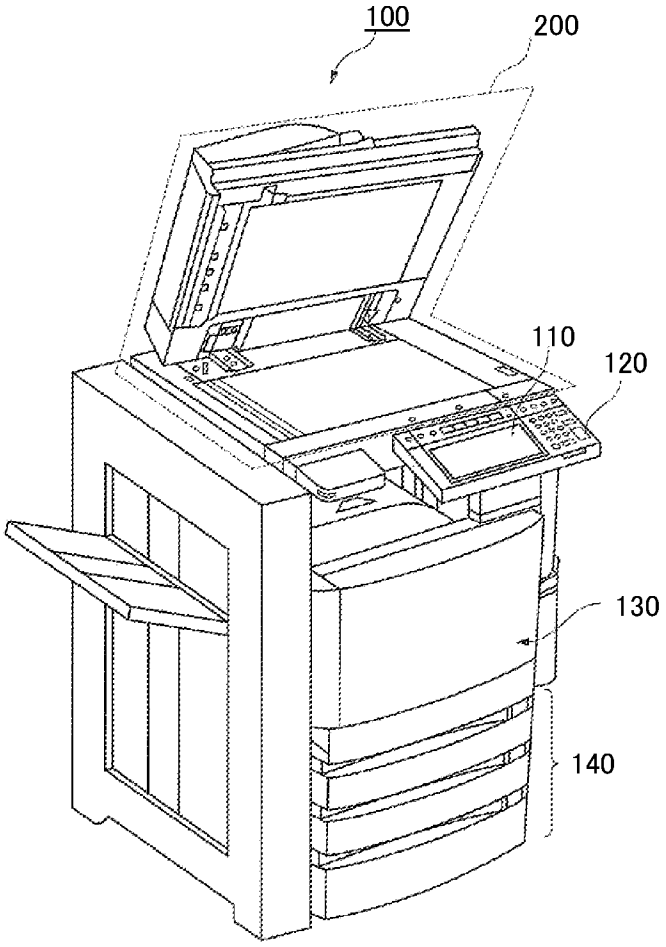
FIG. 1 is an external view showing an example of the overall configuration of an image forming apparatus according to an embodiment.

FIG. 1 is an external view showing an example of the overall configuration of the image forming apparatus 100 according to the embodiment. The image forming apparatus 100 is, for example, a multifunction peripheral. The image forming apparatus 100 includes a display 110, a control panel 120, a printer 130, a sheet storage unit 140, and an image reading unit 200.

The image forming apparatus 100 forms an image on a sheet using a developer such as toner or the like, in the image forming apparatus.

The sheet may be, for example, paper or label paper. The sheet may be of any material as long as the image forming apparatus 100 can form an image on the surface thereof.

The display 110 is an image display device such as a liquid crystal display, an organic EL (Electro Luminescence) display, or the like. The display 110 displays various pieces of information related to the image forming apparatus 100.

The control panel 120 includes a plurality of buttons. The control panel 120 accepts the operation of the user. The control panel 120 outputs a signal corresponding to the operation performed by the user to the control unit of the image forming apparatus 100. The display 110 and the control panel 120 may be configured as a single touch panel.

The printer 130 is a device that forms an image on a sheet with a developer and fixes the formed image on the sheet. The printer 130 forms an image on the sheet based on image information generated by the image reading unit 200 or image information received via the communication path.

The printer 130 forms an image by, for example, the following process. The image forming unit of the printer 130 forms an electrostatic latent image on the photosensitive drum based on the image information. The image forming unit of the printer 130 forms a visible image by applying a developer to the electrostatic latent image. A specific example of the developer is a toner. The transfer portion of the printer 130 transfers the visible image onto the sheet. The fixing unit of the printer 130 fixes the visible image on the sheet by heating and applying pressure to the sheet. The sheet on which the image is formed may be a sheet contained in the sheet storage unit 140, or may be a sheet that has been manually inserted.

The sheet storage unit 140 accommodates a sheet used for image formation in the printer 130.

The image reading unit 200 generates the image information according to the lightness and darkness of light reflected from an image being read. The image reading unit 200 records the image information that has been generated. The recorded image information may be transmitted to another information processing apparatus via the network. The recorded image information may be used in forming an image on the sheet by the printer 130.

Figure 2:
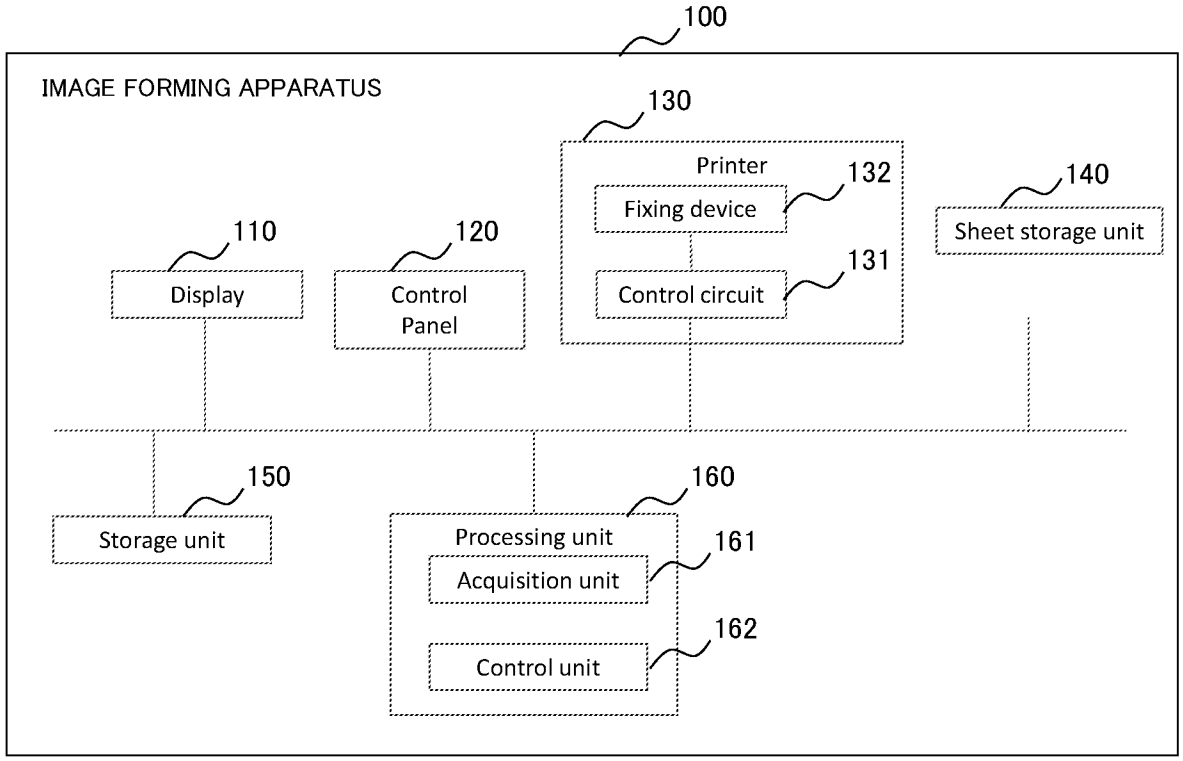
FIG. 2 is a block diagram showing an example of a configuration of an image forming apparatus according to an embodiment.

FIG. 2 is a block diagram showing an example of the configuration of the image forming apparatus 100 according to the embodiment. The image forming apparatus 100 includes the display 110, the control panel 120, the printer 130, the sheet storage unit 140, a storage unit 150, and a processing unit 160.

The image forming apparatus further includes a control circuit 131 and a fixing unit 132.

The storage unit 150 is a nonvolatile recording medium (non-transitory recording medium) such as a flash memory, for example. The storage unit 150 stores, for example, a driver program of the printer 130. The storage unit 150 may further include a volatile recording medium such as a dynamic random access memory (DRAM), for example.

The processing unit 160 includes an acquisition unit 161 and a control unit 162. A part or all of the functions of the processing unit 160 is realized in software by using a processor such as a CPU (Central Processing Unit) executing a program stored in the storage unit 150. A part or all of the functions of the processing unit 160 may be realized by using hardware such as LSI (Large Scale Integration circuit), for example.

Figure 3:
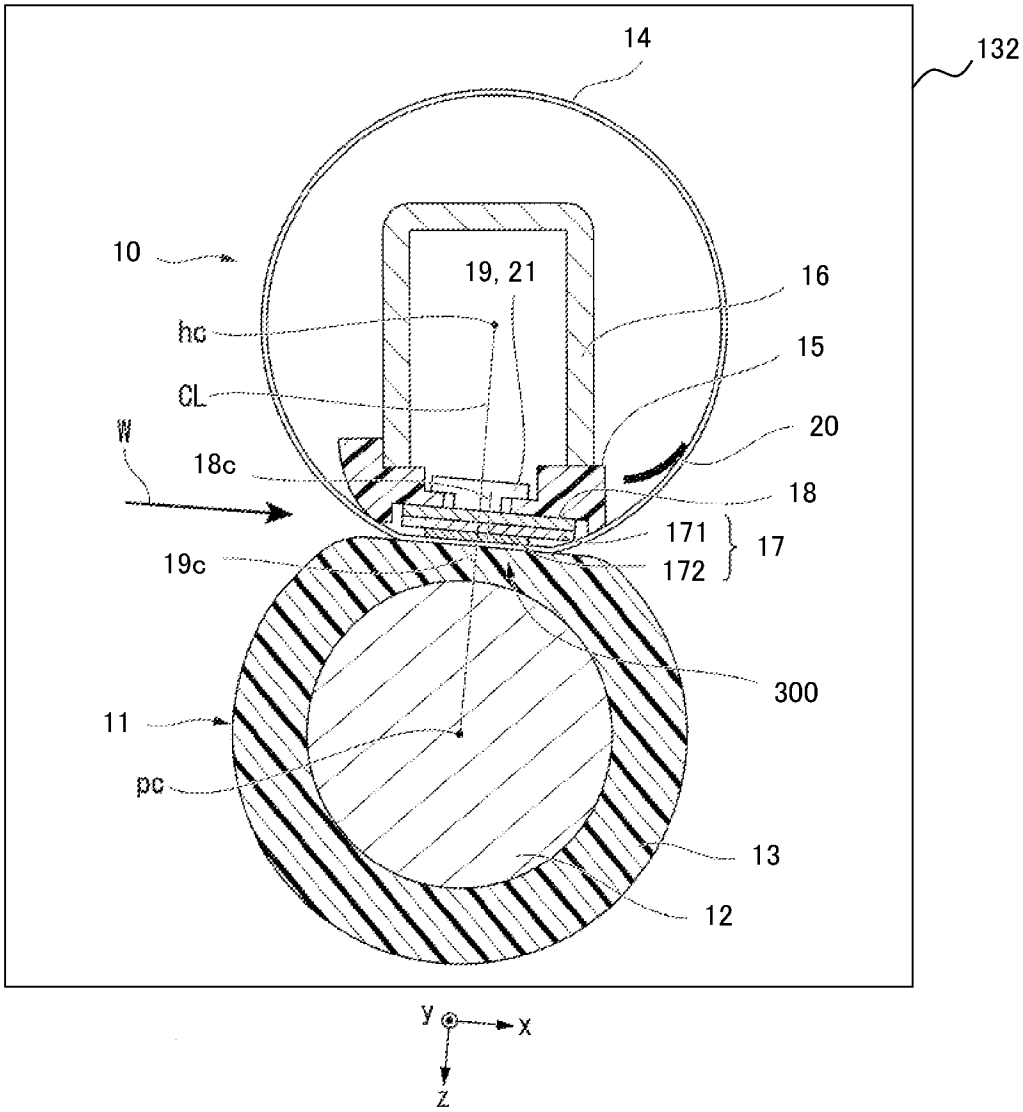
FIG. 3 is a cross-sectional view showing a configuration example of a fixing device according to an embodiment.

Next, the fixing device 132 will be described in detail. FIG. 3 is a cross-sectional view showing an example of the configuration of the fixing device 132 according to the embodiment. The fixing device 132 includes a film unit 10 and a pressure roller 11. The film unit 10 includes a fixing belt 14, a support member 15, a brace 16, a heater unit 17, and a heat transfer member 18.

The fixing device 132 further includes a heater thermometer 19, a film thermometer 20 and a thermostat 21.

When the pressure roller 11 is brought into contact with the film unit 10, the pressure roller 11 and the film unit 10 form a nip 300. The pressure roller 11 and the fixing belt 14 sandwich and support the sheet, on which a toner image is formed, in the nip 300.

The pressure roller 11 applies pressure to the sheet that has entered the nip 300. The pressure roller 11 conveys the sheet by rotation thereof. The pressure roller 11 includes a core metal 12, an elastic layer 13, and a release layer (not shown).

The core metal 12 is made of a metal such as stainless steel or the like. The core metal 12 has a cylindrical shape. At both ends in the axial direction of the core metal 12, the core metal 12 is supported so as to be rotatable. The core metal 12 is driven to rotate by a motor (not shown) such as a brushless motor. The core metal 12 is brought into contact with a mechanism such as a cam member 24 (see FIGS. 5-7). The cam member 24, when rotated, brings the core metal 12 closer to the film unit 10. The cam member may be rotated to bring the elastic layer 13 into contact with the fixing belt 14. The cam member 24 is further rotated to separate the core metal 12 from the film unit 10.

The elastic layer 13 is formed of an elastic material such as silicone rubber. The elastic layer 13 is formed to have a constant thickness on the outer peripheral surface of the core metal 12. The release layer (not shown) is formed of a resin material such as PFA (tetrafluoroethylene perfluoroalkyl vinyl ether copolymer). The release layer is formed on the outer peripheral surface of the elastic layer 13. The hardness of the outer peripheral surface of the pressure roller 11 is, for example, 40~70 degrees under a load of 9.8 N by an ASKER-C hardness meter.

By forming the pressure roller 11 as above range, the area of the nip 300 required for fixing and the durability of the pressure roller 11 are provided adequately.

The control unit 162 controls the operations of the respective units of the image forming apparatus 100. For example, the control unit 162 issues an instruction to the control circuit 131. The control circuit 131 controls the operation of the fixing device 132 based on the instruction. The pressure roller 11 moves towards the film unit 10 by the rotation of the cam member in accordance with the control by the control unit 162. When the control unit 162 controls the pressure roller 11 to move towards the film unit 10 and are pressed by an elastic member (e.g., a pressure spring), a nip 300 is formed.

The pressure roller 11 can be separated from the film unit 10 by the rotation of the cam member in accordance with the control by the control unit 162. For example, in the case where a sheet jam occurs in the fixing device 132, the cam member is rotated to separate the pressure roller 11 from the film unit 10. When the pressure roller 11 is spaced apart from the film unit 10, the user can remove the sheet from the fixing device 132. In a state where the rotation of the fixing belt 14 is stopped, the cam member is rotated to separate the film unit 10 from the pressure roller 11, so that plastic deformation of the fixing belt 14 is prevented.

The pressure roller 11 is driven by the motor to rotate in accordance with the control by the control unit 162. When the pressure roller 11 rotates in a state where the nip 300 is formed, the fixing belt 14 of the film unit 10 is driven to rotate. The pressure roller 11 conveys the sheet in the conveying direction by rotating the sheet in a state in which the sheet is placed in the nip 300. Arrow W shown in FIG. 3 represents the conveying direction of the sheet.

The fixing belt 14 is a band-shaped thin film. The shape of the fixing belt 14 in the fixing device 132 is a cylindrical shape. The fixing belt 14 has a base layer, an elastic layer, and a release layer in this order from the inner peripheral side. The base layer is formed in a cylindrical shape by a material such as nickel or polyimide. The base layer is provided with a heat generating layer, which includes a ceramic or metal layer. A fluorine-based or polyimide-based coating may be applied to the inner side of the base layer to improve the mobility of the fixing belt 14 relative to the heater unit. The elastic layer is laminated and arranged on the outer peripheral surface of the base layer. The elastic layer is formed of an elastic material such as silicone rubber. The release layer is laminated and arranged on the outer peripheral surface of the elastic layer. The release layer is formed of a material such as a PFA resin.

The fixing belt 14 is supported from the inside thereof by a flange (not shown) made of resin. Both ends of the fixing belt 14 are open ends. The fixing belt 14 is rotated in accordance with the rotation of the pressure roller 11. The fixing belt 14 may be connected to a gear. A driving mechanism such as a motor may drive the pressure roller 11 via a gear.

In FIG. 3, a straight line "CL" connecting the center "pc" of the pressure roller 11 and the center hc of the film unit 10 is defined. The heater unit 17 heats the area of the nip 300. The heater unit 17 includes a substrate 171 and a heat generating element set 172. The center 18*c* in the x direction of the substrate 171 is arranged in the +x direction with the straight line "CL" as a reference position. Accordingly, the substrate 171 extends in the +x direction of the nip 300, so that the sheet that has passed through the nip 300 is easily peeled off from the film unit 10.

The center 19*c* in the x direction of the heating element set 172 is disposed on the straight line "CL". The sheet passing through the heating element set 172 and the nip 300 is heated. A heating element set 172 is contained entirely within the area of the nip 300 and is centrally located in the nip 300. Thus, the heat distribution of the nip 300 is equalized, so that the sheet passing through the nip 300 is uniformly heated.

Figure 4:
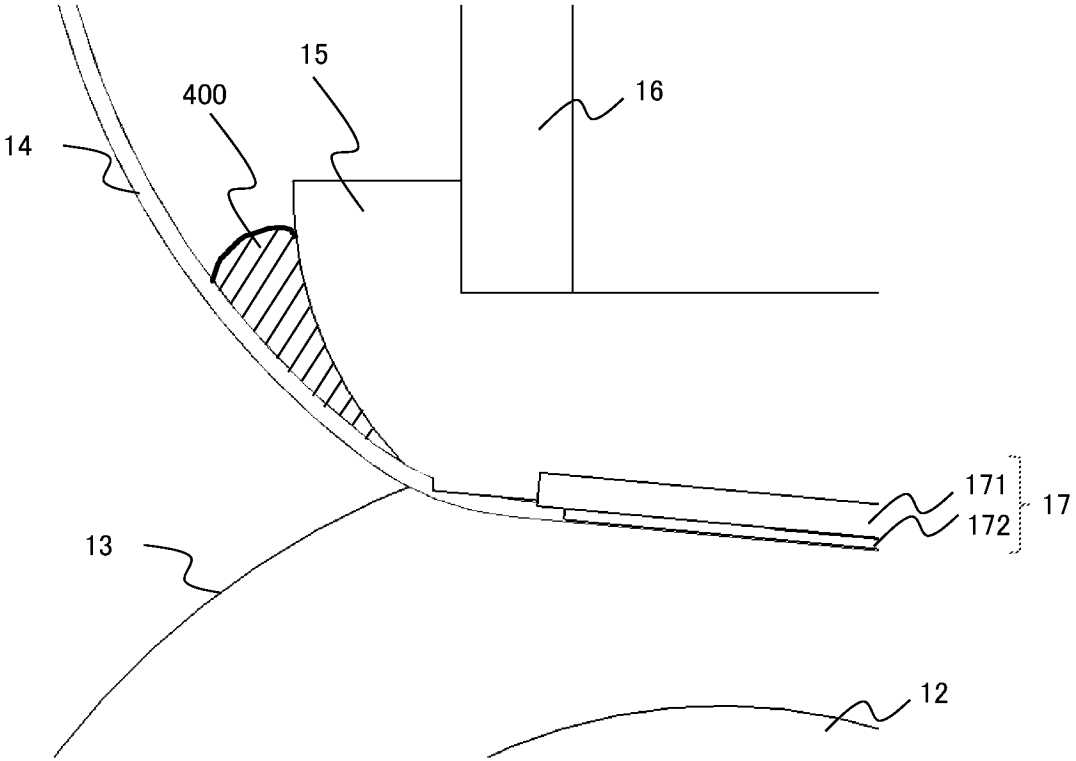
FIG. 4 is a diagram showing an example of a state of a lubricant according to an embodiment.

FIG. 4 is a diagram showing an example of a state of the lubricant 400 according to the embodiment. When the image forming apparatus 100 starts to be used, since there is little impurity in the lubricant 400, and since oil in the lubricant 400 is not volatilized, the motor can drive the pressure roller 11 with low torque. When the image forming apparatus 100 is used for a long time, the lubricant 400 is deteriorated due to the volatilization of the fixing belt 14 and the volatilization of the oil in the lubricant 400. When the lubricant 400 is deteriorated, the pressure roller 11 cannot be driven with the same low torque as before. Until the fixing device 132 is replaced, it is desirable for the pressure roller 11 to be driven with a low torque.

The heater unit 17 is disposed inside the fixing belt 14. A lubricant 400 is applied to the inner peripheral surface of the fixing belt 14 and the heat generating element set 172. The lubricant 400 is, for example, a fluorine grease. The heater unit 17 is in contact with the inner peripheral surface of the fixing belt 14 through the lubricant 400. When the heater unit 17 generates heat, the viscosity of the lubricant 400 decreases. The surface tension of the lubricant 400 varies depending on the viscosity of the lubricant 400. The lubricant 400 penetrates into the gap between the heater unit 17 and the fixing belt 14 in accordance with the surface tension of the lubricant 400.

For example, the lengths of the straight line "CL" shown in FIG. 3 vary in accordance with the mode of the pressure roller 11, which includes an abutting mode, a semi-abutting mode, and a separation mode, and are predetermined, for example, in advance. When the pressure roller 11 is moved to be in the abutting mode, the pressure roller 11 and the fixing belt 14 are in contact with each other at the nip 300, so that a pressure of about 300 N is applied to the fixing belt 14 by the pressure roller 11. When the pressure roller 11 is moved to be in the semi-abutting mode, a pressure of less than 300 N is applied to the fixing belt 14 by a pressure roller 11. When the pressure roller 11 is moved to be in the separation mode, there is a gap between the pressure roller 11 and the fixing belt 14, so that pressure from the pressure roller 11 is not applied to the fixing belt 14.

The lubricant 400 may stagnate at a position where the support member 15 and the fixing belt 14 are in contact with each other. For example, lubricant 400 may stagnate upstream of nip 300. The gap between the heater unit 17 and the fixing belt 14 is appropriately widened, so that the lubricant 400 easily flows into the gap between the heater unit 17 and the fixing belt 14. That is, adjusting the length of the straight line "CL" shown in FIG. 3 may cause the lubricant 400 to more easily penetrate into the gap between the heater unit and the fixing belt 14. Thus, the mobility of the lubricant between the heater unit 17 and the fixing belt 14 is secured.

Figure 5:
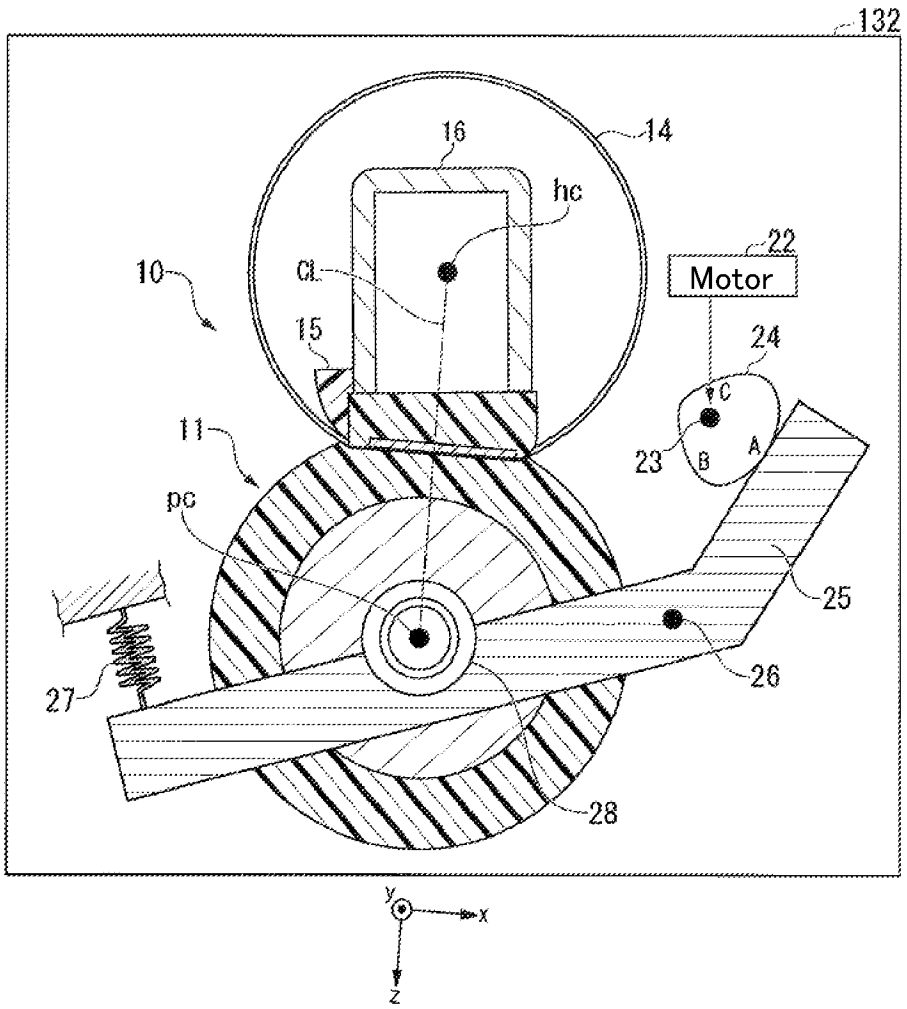
FIG. 5 is a diagram showing a position of a pressure roller in the fixing device, in an abutting mode.

FIG. 5 is a diagram showing the position of the pressure roller 11 in an abutting mode. The fixing device 132 includes a motor 22, a fulcrum 23, a cam member 24, an arm 25, a rotary shaft 26, an elastic member 27, and a bearing 28. The motor 22 drives the fulcrum 23 of the cam member 24 rotationally in accordance with a control signal from the control unit 162. The fulcrum 23 rotates the cam member 24 in response to driving by the motor 22.

In one example, the shape of the arm 25 is substantially L-shaped. A rotary shaft 26 is provided through the bent portion of the arm 25. The arm 25 supports a bearing 28 which is connected to an axis of the center "pc" of the pressure roller 11. The rotary shaft 26 rotatably supports the arm 25. The elastic member 27 is a compression spring, e.g., a compression coil spring. The elastic member 27 is disposed between the wall provided in the fixing device 132 and the arm 25. The elastic member 27 is compressed by the arm 25 rotated clockwise against the wall provided in the fixing device 132. The compressed elastic member 27 pressurizes the arm 25 so that the arm 25 comes into contact with the cam member 24. The bearing 28 rotatably supports the pressure roller 11 at the center "pc" of the pressure roller 11. In FIG. 5, a contact point between the cam member 24 and the arm 25 is denoted by a contact point "A" of the abutting position. In FIG. 5, the cam member 24 receives, from the arm 25, a force having a magnitude corresponding to the length of the compressed elastic member 27 at the contact point "A" of the abutting position. Since the distance between the fulcrum 23 and the contact point "A" of the abutting position is longer than the predetermined distance, the film unit 10 and the pressure roller 11 are in contact with each other.

Figure 6:
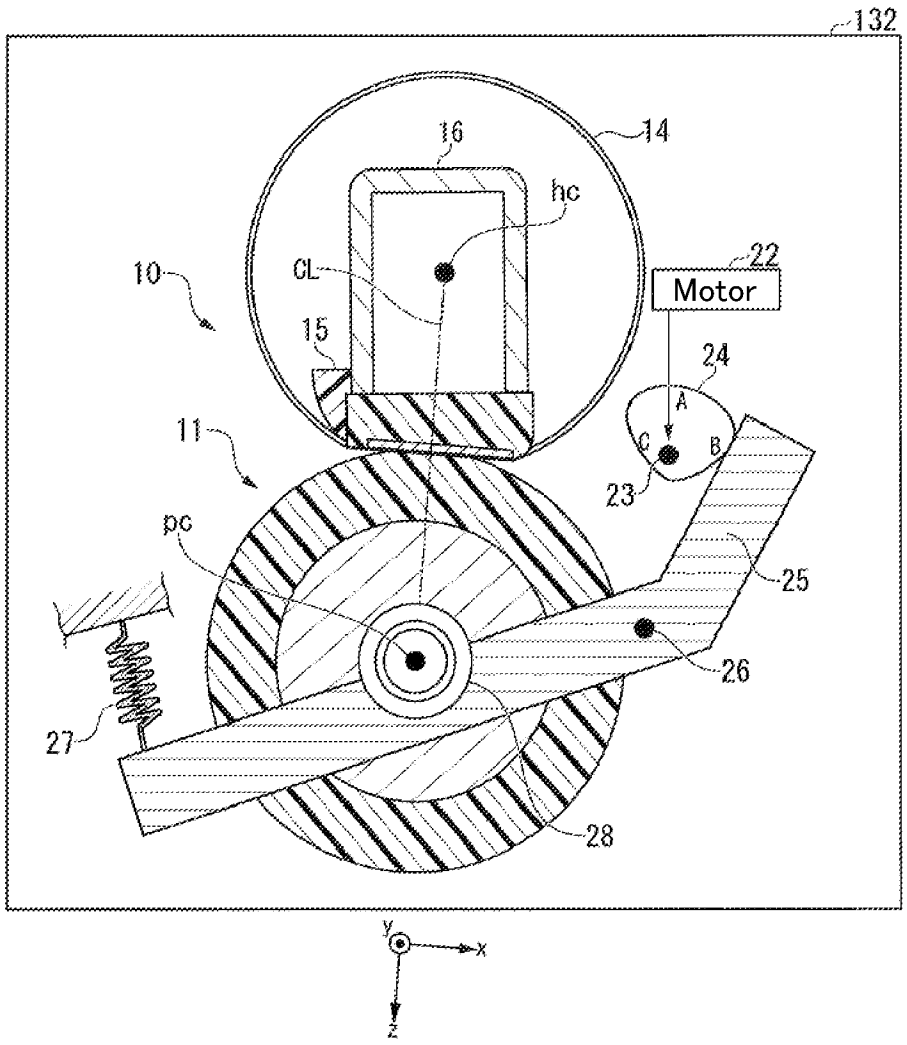
FIG. 6 is a diagram showing a position of the pressure roller in the fixing device, in a semi-abutting mode.

FIG. 6 is a diagram showing a position of the pressure roller 11 in a semi-abutting mode. In FIG. 6, a contact point between the cam member 24 and the arm 25 is denoted by a contact point "B" of a semi-abutting position. In FIG. 6, the cam member 24 receives, from the arm 25, a force having a magnitude corresponding to the length of the compressed elastic member 27 at a contact point "B" of the semi-abutting position. The distance between the fulcrum 23 and the contact point "B" of the semi-abutting position is shorter than the distance between the fulcrum 23 and the contact point "A" of the abutting position. Therefore, the arm 25 rotates counterclockwise about the rotary shaft 26 when the cam member 24 rotates counterclockwise from a position where it abuts the arm 25 at contact position "A" to a position where it abuts the arm 25 at contact point "B". The length of the straight line "CL" shown in FIG. 6 is longer than the length of the straight line "CL" shown in FIG. 5 in accordance with a change in the rotation angle of the arm 25.

Figure 7:
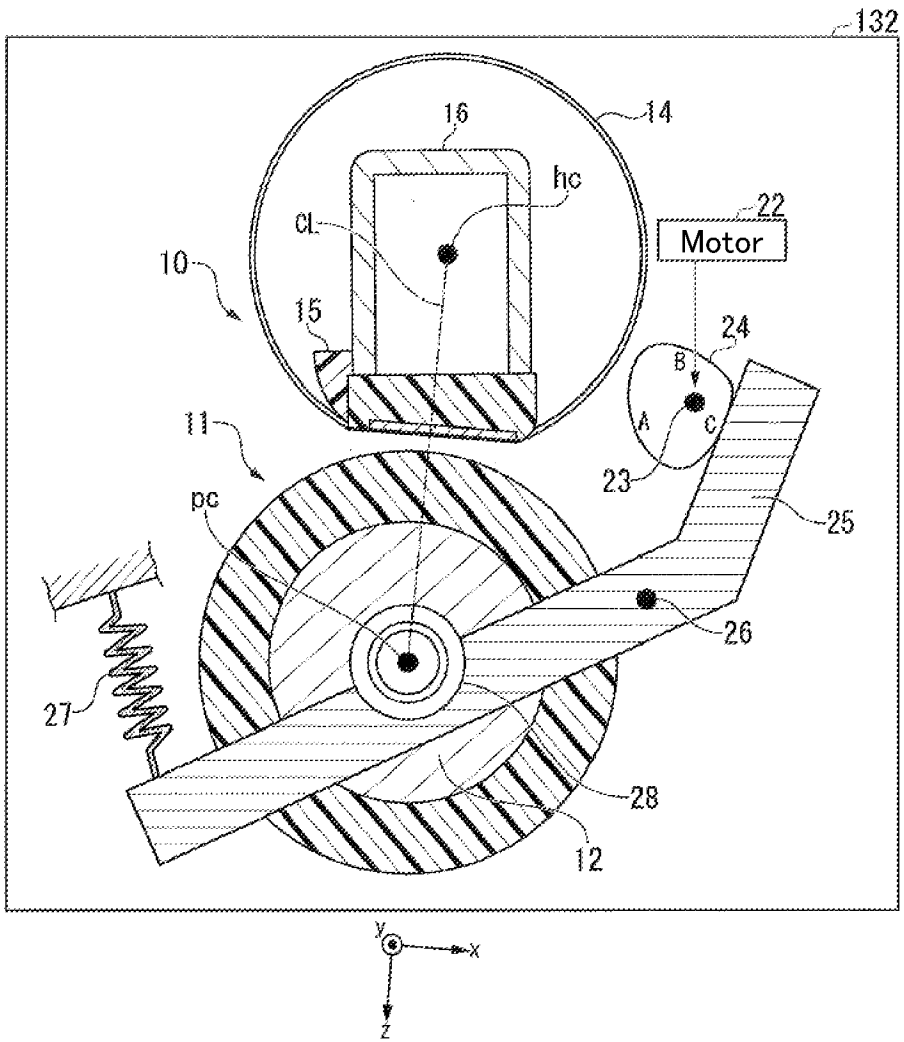
FIG. 7 is a diagram showing a position of the pressure roller in the fixing device, in a separation mode.
Figure 8:
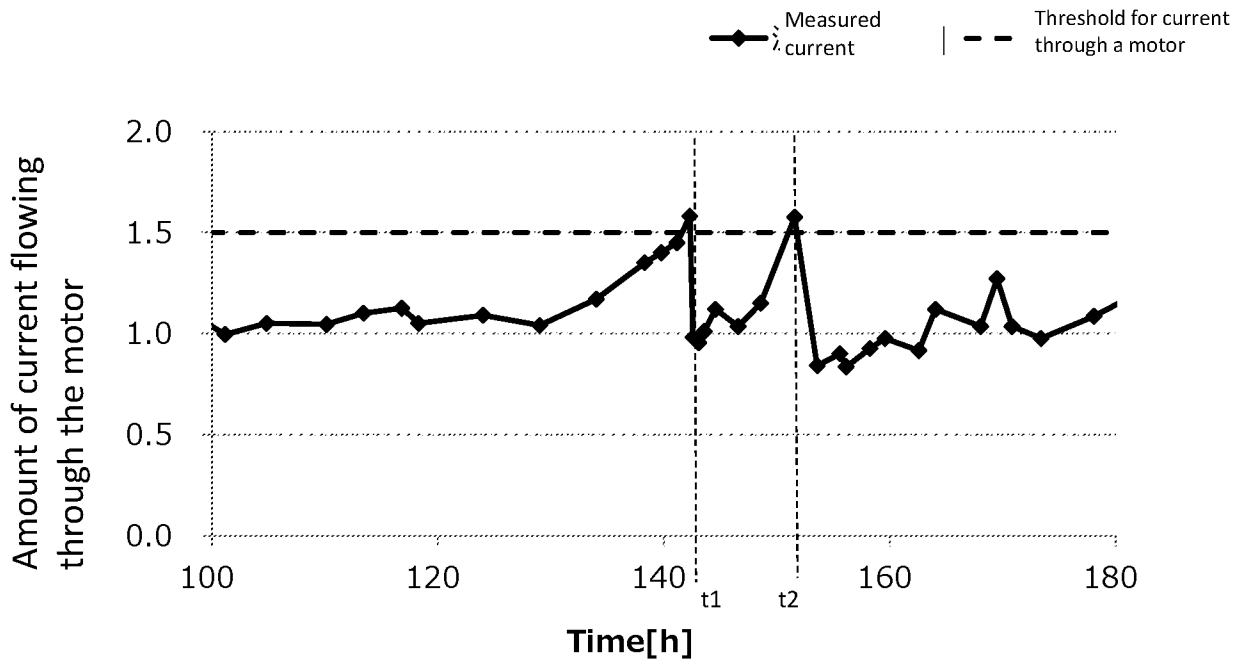
FIG. 8 is a diagram illustrating an example of a change in a current value of a motor according to an embodiment.
Figure 9:
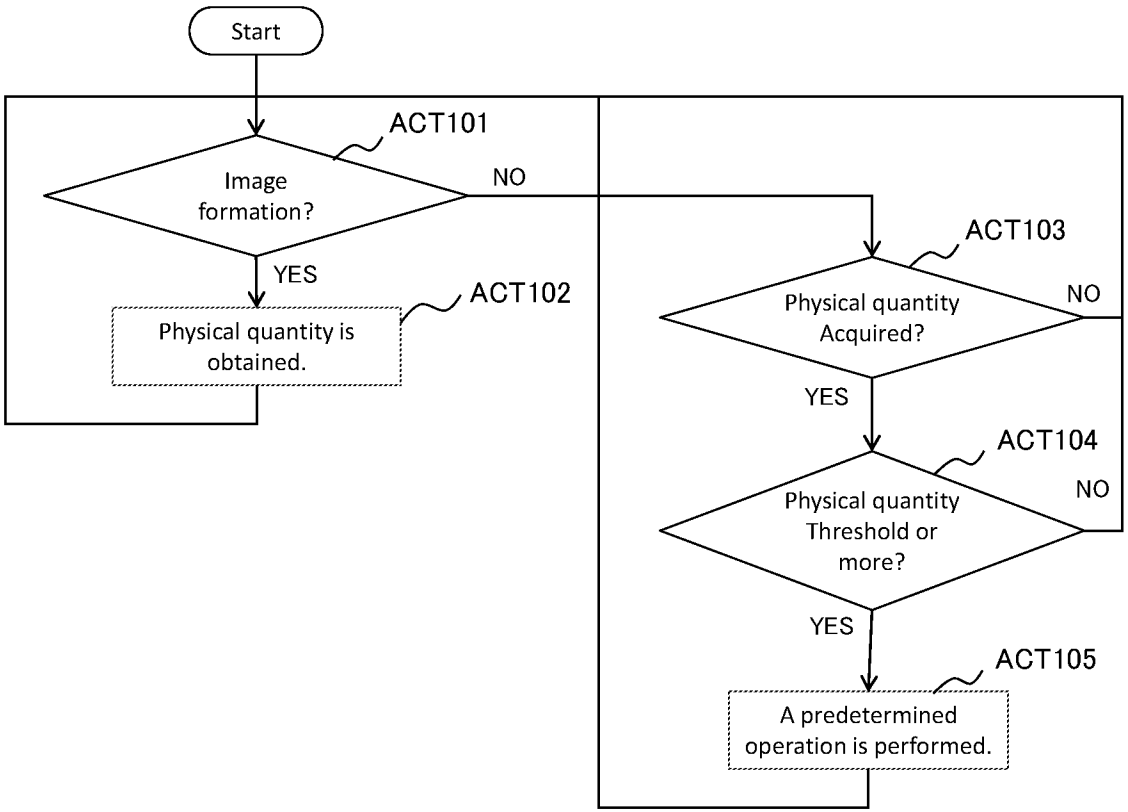
FIG. 9 is a flowchart illustrating an operation example of an image forming apparatus according to an embodiment.

FIG. 7 is a diagram showing a position (of the pressure roller 11 in a separation mode. In FIG. 7, a contact point between the cam member 24 and the arm 25 is denoted by a contact point "C" of the separation position. In FIG. 7, the cam member 24 receives a force from the arm 25 at the contact point "C" of the separation position, the force having a magnitude corresponding to the length of the compressed elastic member 27. The distance between the fulcrum 23 and the contact point C of the separation position is shorter than the distance between the fulcrum 23 and the contact point B of the semi-abutting position. Therefore, the arm 25 rotates further counterclockwise around the rotary shaft 26 in the counterclockwise direction than shown in FIG. 6. The length of the straight line "CL" shown in FIG. 7 is longer than the length of the straight line "CL" shown in FIG. 6 in accordance with a change in the rotation angle of the arm 25. Since the distance between the fulcrum 23 and the contact point "C" of the separation position is shorter than a predetermined distance, the film unit 10 and the pressure roller 11 are separated from each other. Therefore, the heat of the heater unit 17 is not transmitted to the pressure roller 11.

Referring back to FIG. 3, the configuration example of the fixing device 132 will continue to be described. The heat transfer member 18 is made of a metal material having a high thermal conductivity such as copper. The outer shape of the heat transfer member 18 is equivalent to the outer shape of the substrate 171 of the heater unit 17. The heat transfer member 18 is in contact with the surface of the heater unit 17 in the −z direction. The surface in the −z direction is the surface opposite to the surface in which the heater unit 17 is in contact with the fixing belt 14.

The support member 15 is formed of a resin material such as a liquid crystal polymer. The support member 15 is disposed so as to cover the −z direction of the heater unit 17 and the both sides in the x direction. The support member 15 supports the heater unit 17 via the heat transfer member 18. Rounded chamfering is formed at both end portions in the x direction of the support member 15. The support member 15 supports the inner peripheral surface of the fixing belt 14 at both end portions in the x direction of the heater unit 17.

When the sheet passing through the fixing device 132 is heated, a temperature distribution is generated in the heater unit 17 in accordance with the size of the sheet. When the heater unit 17 attains a locally high temperature, the temperature of the heater unit 17 may exceed the heat resistant temperature of the support member 15 formed of a resin material. When the temperature of the heater unit 17 exceeds the heat resistant temperature of the support member 15, the resin material that form the support member 15 is melted and damaged. The heat transfer member 18 distributes the heat to achieve a proper temperature distribution of the heater unit 17 that prevents locally high temperatures. As a result, heat resistance of the support member 15 is ensured.

The brace 16 is formed of a steel sheet material or the like. A cross section perpendicular to the y direction of the brace 16 is formed in a U shape. The brace 16 is mounted in the −z direction of the support member 15 so as to block the opening of the U shape by the support member 15. The brace 16 extends in the y direction. Both end portions in the y direction of the brace 16 are fixed to the housing of the image forming apparatus 100. As a result, the film unit 10 is supported by the image forming apparatus 100. The brace 16 improves the bending rigidity of the film unit 10. A flange (not shown) for restricting the movement of the fixing belt 14 in the y direction is mounted in the vicinity of both end portions in the y direction of the brace 16.

The heater thermometer 19 is arranged in the −z direction of the heater unit 17 with the heat transfer member interposed therebetween. For example, the heater thermometer 19 may be a thermistor. The heater thermometer is mounted on and supported by a surface in the −z direction of the support member 15. The temperature sensing element of the heater thermometer 19 contacts the heat transfer member 18 through a hole passing through the support member 15 in the z direction. The heater thermometer 19 measures the temperature of the heater unit 17 via the heat transfer member 18.

The film thermometer 20 is disposed inside the fixing belt 14 and in the +x direction of the heater unit 17. The film thermometer 20 measures the temperature of the fixing belt 14 by coming into contact with the inner peripheral surface of the fixing belt 14.

The thermostat 21 is arranged in the same manner as the heater thermometer 19. The thermostat 21 is incorporated in an electric circuit. When the temperature of the heater unit 17 detected through the heat transfer member 18 exceeds a predetermined temperature, the thermostat 21 cuts off the power supply to the heat generating element set 172.

Next, the details of the processing apparatus 160 shown in FIG. 2 will be described.

The acquisition unit 161 acquires a physical quantity that varies according to the magnitude of the torque of the pressure roller 11. For example, the acquisition unit 161 acquires a current value of a motor (not shown) for driving the core metal 12 of the pressure roller 11. A mechanism (not shown) for detecting the current value of the motor is disposed within a predetermined distance from the core metal 12, for example.

When the rated current value of the motor is 2 A, for example, and a margin of, for example, 25% is secured for the rated current value, the threshold value of the current value of the motor is determined to be 1.5 A. The threshold information is stored in, for example, the storage unit 150. The control unit 162 acquires threshold information from the storage unit 150 when image formation is performed by the fixing unit 132. The image formation by the fixing device 132 is performed, for example, during the execution of the print job.

The control unit 162 determines whether or not the current value of the motor for driving the core metal 12 is equal to or larger than a threshold value. When it is determined that the current value of the motor is equal to or larger than the threshold value, and when the image forming operation is not performed by the fixing device 132, the control unit 162 shifts the operation mode of the fixing device 132 to the lubricant circulation mode.

This is the case.

The case where the image formation is not performed by the fixing device 132, for example, immediately after the execution of the print job, before the execution of the print job, during the warm-up of the fixing device 132, immediately after the warm-up of the fixing device 132, and during the execution of the processing for maintaining the image quality (e.g., the density check process of the toner) is performed, or during the execution of the alignment processing of the predetermined mechanism of the fixing device 132.

The lubricant circulation mode is an operation mode in which the length of the straight line "CL" shown in FIG. 3 is changed 1 or more times in a state where the rotary driving of the fixing belt 14 and the pressure roller 11 is stopped. That is, the lubricant circulation mode is an operation mode in which the gap between the heater unit 17 and the fixing belt 14 is changed by the control unit 162 in a state where the rotary driving of the fixing belt 14 and the pressure roller 11 is stopped. In the lubricant circulation mode, the control unit 162 and reduce the pressure applied to the heater unit 17 from the pressure roller 11. In the lubricant circulation mode, the control unit 162 and increase the distance between the heater unit 17 and the center axis of the pressure roller 11.

In the control unit 162 and, the distance between the heater unit 17 and the fixing belt 14 may be changed a plurality of times in the lubricant circulation mode. Fresh lubricant 400 stagnating upstream of the nip 300 penetrates into the open gap between the heater unit 17 and the fixing belt 14 in the lubricant circulation mode. Thus, the performance of lubricant 400 in nip 300 is restored. The control unit 162 and may execute the operation of changing the distance between the gaps a plurality of times when: (1) the operation for changing the distance between the gaps has been executed 1 or more times in the pressure roller 11, and after a predetermined condition described below is satisfied. The predetermined condition is a condition that the number of sheets to be printed is equal to or less than a predetermined number, and a condition that the elapsed time is within a predetermined time. When the torque of the pressure roller 11 becomes high immediately after the pressure roller 11 or the like is operated in the lubricant circulation mode (when the physical quantity becomes large), there is a possibility that the operation of the lubricant circulation mode may be insufficient. Therefore, when the torque of the pressure roller 11 becomes high immediately after the pressure roller 11 or the like is operated in the lubricant circulation mode, the control unit 162 and may execute the operation of changing the distance of the gap to the pressure roller 11 a plurality of times.

In the control unit 162 and, the pressure applied to the heater unit 17 by the pressure roller 11 may be reduced a plurality of times in the lubricant circulation mode. The control unit 162 and may execute the operation of changing the pressure a plurality of times when: (1) the operation for changing the pressure has been executed one or more times on the pressure roller 11 and the predetermined condition is satisfied. In the control unit 162 and, the distance between the heater unit 17 and the center axis of the pressure roller 11 may be increased a plurality of times in the lubricant circulation mode. The control unit 162 and may execute the operation of changing the distance a plurality of times, in the case where the operation for changing the distance between the heater unit 17 and the center axis of the pressure roller 11 is executed 1 or more times on the pressure roller 11, and after the predetermined condition is satisfied, the operation for changing the distance is executed again on the pressure roller 11.

FIG. 5 is a diagram showing an example of a change in the current value of the motor according to the embodiment. The torque limit value of the rated load of the motor for driving the core metal 12 for rotating the pressure roller is, for example, 100 milliNewtons·meter. There is a correlation between the driving force of the motor driving the pressure roller 11 and the amount of current input to the motor. The control unit 162 increases the amount of current input to the motor in accordance with the load torque of the pressure roller 11, thereby maintaining the specified rotational speed of the pressure roller 11 and the fixing belt 14.

In FIG. 5, at time t 1, the control unit 162 determines that the current value of the motor is equal to or larger than the threshold value. When it is determined that the current value of the motor is equal to or larger than the threshold value, and the image forming operation is not performed by the fixing device 132, the control unit 162 shifts the operation mode of the fixing device 132 to the lubricant circulation mode. The lubricant 400 penetrates into the open gap between the heater unit 17 and the fixing belt 14 in the lubricant circulation mode. Thus, the performance of lubricant 400 in nip 300 is restored. Since the drive torque of the pressure roller 11 temporarily decreases, the low torque state of the pressure roller 11 is maintained for a predetermined time.

The control unit 162 repeats the change in the distance between the heater unit 17 and the fixing belt 14 in the lubricant circulation mode, thereby prolonging the life of the fixing device 132. In FIG. 5, at time t 2, the control unit 162 again determines that the current value of the motor is equal to or larger than the threshold value. When it is determined that the current value of the motor is equal to or larger than the threshold value, and when the image formation is not performed by the fixing device 132, the control unit 162 shifts the operation mode of the fixing device 132 to the lubricant circulation mode.

For example, when the fixing device 132 forms a toner image on a predetermined number of sheets, e.g., about 200000 to 600000 sheets, the fixing device 132 may be replaced.

Next, an example of the operation of the image forming apparatus 100 will be described.

FIG. 6 is a flowchart illustrating an operation example of the image forming apparatus 100 according to the embodiment.

The acquisition unit 161 determines whether or not the fixing device 132 fixes an image on the sheet.

That is, the acquisition unit 161 determines whether or not the image forming process (fixing process) is performed by the fixing device 132 (ACT 101).

When the image forming process is performed (ACT 101: YES), the acquisition unit 161 acquires a physical quantity that varies according to the magnitude of the torque of the pressure roller 11 (ACT 102).

The process then returns to ACT 101.

When the image forming process is not performed (ACT 101: NO), the control unit 162 determines whether or not the physical quantity is acquired by the acquiring unit 161 (ACT 103). When the physical quantity is not acquired by the acquisition unit 161 (ACT 103: NO), the acquisition unit 161 returns the process to ACT 101. When the physical quantity is already acquired by the acquisition unit 161 (ACT 103: YES), the control unit 162 determines whether or not the physical quantity is equal to or larger than the threshold value (ACT 104).

When the physical quantity is less than the threshold value (ACT 104: NO), the control unit 162 returns the process to ACT 101. When the physical quantity is equal to or larger than the threshold value (ACT 104: YES), the control unit 162 causes the pressure roller 11 to execute a predetermined operation so as to create a gap between the heat generating element set 172 and the fixing belt 14 (ACT 105). The control unit 162 returns the process to ACT 101.

As described above, the image forming apparatus 100 according to the first embodiment includes the fixing device 132 and the acquisition unit 161.

The fixing device 132 includes a heater unit 17, a fixing belt 14, a pressure roller 11, and a lubricant 400. The heater unit 17 generates heat. The fixing belt 14 is a strip-shaped thin film which moves on the surface of the heater unit 17 while making contact with the heater unit 17 on the inner peripheral surface of the fixing belt 14. The pressure roller 11 can be pressed and rotated on the outer peripheral surface of the fixing belt 14. The lubricant 400 is in contact with the inner peripheral surface of the fixing belt 14. The acquisition unit 161 acquires a physical quantity that varies according to the magnitude of the torque of the pressure roller 11. The physical quantity is, for example, an amount of current. The acquisition unit 161 may acquire the measured torque information or temperature information of the pressure roller 11. Based on the physical quantity obtained at the time of image formation by the fixing device 132, the control unit 162 causes the pressure roller 11 to execute the predetermined operation so that a gap between the heater unit 17 and the fixing belt 14 can be formed.

Accordingly, the image forming apparatus 100 according to the first embodiment can prevent the driving torque of the fixing device 132 from becoming high.

In the image forming apparatus 100 according to the first embodiment, the lubricant circulation mode is executed in accordance with the magnitude of the torque of the pressure roller 11, and not executed when only the predetermined time has elapsed. Therefore, the image forming apparatus 100 can prevent an increase in the number of times the consumable articles such as the pressure roller 11 and the fixing belt 14 are rotationally driven. That is, the image forming apparatus 100 is capable of driving the pressure roller 11 with a stable low torque until the unit replacement time specified by the fixing device 132 is reached. The image forming apparatus 100 can reduce a loss time for which a print job cannot be executed.

The pressure roller 11 may be marked with a mark. The rotational speed of the mark applied to the pressure roller 11 may be measured, for example, by means of an image sensor. The acquisition unit 161 may derive the torque of the pressure roller 11 based on the relationship between the rotation speed of the mark applied to the pressure roller 11 and the current value of the motor. The control unit 162 may determine whether or not the torque of the pressure roller 11 is equal to or larger than a threshold value. When it is determined that the torque of the pressure roller 11 is equal to or greater than the threshold value and when the image formation is not performed by the fixing device 132, the control unit 162 may shift the operation mode of the fixing device 132 to the lubricant circulation mode.

Second Embodiment

The second embodiment is different from the first embodiment in that the control unit 162 rotates the pressure roller 11 and the fixing belt 14 in the lubricant circulation mode. In the second embodiment, a difference from the first embodiment will be described.

In a case where the load torque of the pressure roller 11 is equal to or greater than a predetermined torque value in the lubricant circulation mode, the control unit 162 and may change the distance between the heater unit 17 and the fixing belt 14 while rotating the pressure roller 11 and the fixing belt 14. The lubricant 400 disposed in the nip 300 is heated by the heater unit 17. Thus, the degradation of lubricant 400 located in nip 300 is faster than lubricant 400 located away from nip 300. The control unit 162 and change the distance between the heater unit 17 and the fixing belt 14, and rotate the fixing belt 14 to move the lubricant 400 having a low degree of deterioration to a position closer to the nip 300. In this manner, the control unit 162 and causes the lubricant 400 adhering to the inner peripheral surface of the fixing belt 14 to be more uniformly degraded. Thereby, the control unit 162 and can keep the driving torque of the fixing device 132 low. In the lubricant circulation mode, the control unit 162 and may reverse the rotation direction of the pressure roller 11. As a result, the control unit 162 and can deform the lubricant 400.

As described above, in the control unit 162 of the second embodiment, the pressure roller 11 is rotated in the lubricant circulation mode. Since the amount of lubricant 400 supplied to the nip 300 is increased by the conveyance by the fixing belt 14, it is possible to drive the pressure roller 11 with a low driving torque. For example, even if the amount of lubricant 400 located in the nip 300 decreases, the amount of lubricant 400 located in the nip 300 can be increased by rotating the fixing belt 14. When the current value of the motor becomes equal to or larger than the threshold value in accordance with the driving torque, the fixing belt 14 may be rotated to increase the amount of the lubricant 400 disposed in the nip 300.

Third Embodiment

The third embodiment differs from the first embodiment in that the lubricant 400 is heated in accordance with the control by the control unit 162 in the lubricant circulation mode. In the third embodiment, a difference from the first embodiment will be described.

When the environmental temperature in the image forming apparatus 100 is significantly lower than the normal temperature or when the toner image is formed and the number of sheets (the number of printing portions) is small, the temperature of the lubricant 400 is low. When the temperature of the lubricant 400 is low, the lubricant 400 has a high viscosity, so that lubricating properties of the lubricant 400 are low. In the lubricant circulation mode, when the ambient temperature within the image forming apparatus 100 is equal to or lower than the predetermined temperature, the control unit 162 and may change the distance between the heater unit 17 and the fixing belt 14 while heating the fixing belt 14 by the heater unit 17. Thus, since the temperature of the lubricant 400 becomes high, the viscosity of the lubricant 400 becomes low.

Since the fixing belt 14 and the pressure roller 11 are not rotated, the heater unit 17 heats the fixing belt 14 at a temperature that does not cause damage to the fixing belt 14 and the pressure roller 11. When the rated power of the heater unit 17 is 1000 W, for example, the electric power for generating a temperature sufficient to prevent damage to the fixing belt 14 and the pressure roller 11 is about 300 W, for example.

As described above, in the control unit 162 according to the third embodiment, when the ambient temperature is equal to or lower than the predetermined temperature, the heater unit 17 is caused to generate heat in the lubricant circulation mode. As a result, according to the image forming apparatus 100 in the third embodiment, it is possible to further improve the mobility of the fixing belt 14 with the heater unit 17 (lubricity of lubricant 400) with respect to the image forming apparatus in the first embodiment The first embodiment, the second embodiment, and the third embodiment may be combined with each other. For example, when the interval between the execution time of the previous lubricant circulation mode and the execution time of the lubricant circulation mode at this time is within a predetermined time, the image forming apparatus 100 determines that the temperature or the load torque becomes severe. When the number of printed sheets is equal to or larger than a predetermined number, the image forming apparatus 100 may determine that the conditions of temperature or load torque become severe. When it is determined that the condition of the temperature or the load torque becomes severe, the image forming apparatus 100 may perform the operation of rotating the pressure roller 11 and the fixing belt 14 in preference to the operation of the first embodiment in accordance with the control by the control unit 162 in the lubricant circulation mode.

When the increase in the load torque of the pressure roller 11 is caused by the oxidation of the lubricant 400, the control unit 162 may execute control for adding a substance for neutralizing oxidation to the lubricant 400. In this case, the control unit 162 does not have to change the distance between the heater unit 17 and the fixing belt 14.

According to at least one embodiment described above, it is possible to prevent the driving torque of the fixing device from becoming high.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a fixing device having a heat generating element, a fixing belt which moves along a surface of the heat generating element while an inner peripheral surface of the fixing belt makes contact with the heat generating element, a rotatable body configured to be pressed against an outer peripheral surface of the fixing belt, and a lubricant which is applied to and in contact with the inner peripheral surface of the fixing belt; and a processor configured to acquire a physical quantity which changes in accordance with a magnitude of a torque that is applied to rotate the rotatable body, and cause the rotatable body to execute a predetermined operation to increase a gap between the heat generating element and the fixing belt, based on the physical quantity acquired while the fixing device is carrying out image formation, such that the gap is increased if the physical quantity acquired while the fixing device is carrying out image formation is within a first range of values and the gap is not increased if the physical quantity acquired while the fixing device is carrying out image formation is within a second range of values, wherein the first range of values and the second range of values do not overlap, wherein when a predetermined condition is satisfied after the predetermined operation is executed, the processor causes the rotatable body to execute the predetermined operation a plurality of times.

2. The image forming apparatus according to claim 1, wherein the predetermined operation is an operation to reduce a pressure applied to the heat generating element by the rotatable body.

3. The image forming apparatus according to claim 1, wherein the predetermined operation is an operation to increase a distance between the heat generating element and a central axis of the rotatable body.

4. The image forming apparatus according to claim 1, wherein the physical quantity is a current value of a motor for driving a rotation of the rotatable body.

5. The image forming apparatus according to claim 4, wherein the processor causes the rotatable body to execute the predetermined operation when the current value is greater than or equal to a threshold value.

6. The image forming apparatus according to claim 1, wherein the processor is configured to cause the rotatable body to execute the predetermined operation while the rotatable body is being rotated.

7. The image forming apparatus according to claim 1, wherein the processor is configured to cause the rotatable body to execute the predetermined operation while the heat generating element is generating heat.

8. The image forming apparatus according to claim 1, wherein the processor is configured to cause the rotatable body to execute the predetermined operation while the rotatable body is being rotated and the heat generating element is generating heat.

9. A method of maintaining a fixing device of an image forming apparatus, the fixing device having a heat generating element, a fixing belt which moves along a surface of the heat generating element while an inner peripheral surface of the fixing belt makes contact with the heat generating element, a rotatable body configured to be pressed against an outer peripheral surface of the fixing belt, and a lubricant which is applied to and in contact with the inner peripheral surface of the fixing belt, said method comprising:

acquiring a physical quantity which changes in accordance with a magnitude of a torque that is applied to rotate the rotatable body, while the fixing device is carrying out image formation;

executing a predetermined operation with the rotatable body to increase a gap between the heat generating element and the fixing belt, based on the acquired physical quantity, such that the gap is increased if the acquired physical quantity is within a first range of values and the gap is not increased if the acquired physical quantity is within a second range of values, wherein the first range of values and the second range of values do not overlap; and when a predetermined condition is satisfied after the predetermined operation is executed, executing the predetermined operation with the rotatable body a plurality of times.

10. The method of claim 9, wherein the predetermined operation is an operation to reduce a pressure applied to the heat generating element by the rotatable body.

11. The method of claim 9, wherein the predetermined operation is an operation to increase a distance between the heat generating element and a central axis of the rotatable body.

12. The method of claim 9, wherein the physical quantity is a current value of a motor for driving a rotation of the rotatable body.

13. The method of claim 12, wherein the rotatable body executes the predetermined operation when the current value is greater than or equal to a threshold value.

14. The method of claim 9, wherein the rotatable body executes the predetermined operation while the rotatable body is being rotated.

15. The method of claim 9, wherein the rotatable body executes the predetermined operation while the heat generating element is generating heat.

16. The method of claim 9, wherein the rotatable body executes the predetermined operation while the rotatable body is being rotated and the heat generating element is generating heat.

* * * * *